US006158200A

United States Patent [19]

Taylor et al.

[11] Patent Number: 6,158,200

[45] Date of Patent: Dec. 12, 2000

[54] APPARATUS AND METHOD FOR PRODUCING PACKAGES BY VIBRATING BAG MATERIAL

[75] Inventors: Alfred Taylor, Chester Hill; Robert Erich Fritz, Camden; Luigi DiPalma, Kingsgrove, all of Australia

[73] Assignee: TNA Australia Pty Limited, Chester Hill, Australia

[21] Appl. No.: 09/198,821

[22] Filed: Nov. 23, 1998

[30] Foreign Application Priority Data

Nov. 24, 1997 [AU] Australia ..... PP0519

[51] Int. Cl.[7] ..... B65B 9/00

[52] U.S. Cl. ..... 53/451; 53/551; 53/64

[58] Field of Search ..... 53/64, 437, 525, 53/451, 551, 552

[56] References Cited

U.S. PATENT DOCUMENTS

| | | | |
|---|---|---|---|
| 4,288,965 | 9/1981 | James | 53/64 |
| 4,663,917 | 5/1987 | Taylor et al. | 53/552 |
| 4,800,707 | 1/1989 | Rabus | 53/552 |
| 4,825,623 | 5/1989 | Ross | 53/437 |
| 4,910,943 | 3/1990 | Taylor et al. | 53/551 |
| 5,485,712 | 1/1996 | Cherney et al. | 53/436 |
| 5,533,322 | 7/1996 | Bacon et al. | 53/451 |

*Primary Examiner*—John Sipos
*Assistant Examiner*—Steven Jensen
*Attorney, Agent, or Firm*—Ladas & Parry

[57] ABSTRACT

A packaging machine (11) in which tubular bag material (16) is driven through the machine and caused to vibrate in the general direction of movement of the tubular bag material to aid in settling products so that the product occupies a minimum volume during formation of bags containing the product.

7 Claims, 6 Drawing Sheets

APPARATUS AND METHOD FOR PRODUCING PACKAGES BY VIBRATING BAG MATERIAL

TECHNICAL FIELD

The present invention relates to packaging machines which receives a plastic film and product to be packaged, and forms discrete packages therefrom. For example, the product may be a snack food.

BACKGROUND OF THE INVENTION

Described in U.S. Pat. Nos. 4,910,943, 4,663,917, 439, 108, 3,850,780, 4,128,985, 4,288,965, 442,385, 5,551,206, 5,125,217, 5,366,130, 5,463,850, 5,537,798, 5,622,033 and European Patents 0275181 and 0165819 are various packaging machines. In essence each of the packaging machines receives a strip of plastic film which is pulled passed a former so as to form a tube. The edges of the strip are sealed together and product delivered to the interior of the tube through the former. A sealing head engages the tube and forms the discrete bags which are then severed from the remainder of the tube. Typically closing bars and/or stripping bars may be employed to aid the packaging process.

The film can be pulled through the packaging machine by a variety of methods. For example the machine may be provided with a pair of co-operating belts, as described in a number of the above patent specifications, to which a vacuum may or may not be delivered. The film is drawn into contact with the driven belts to thereby pull the film through the machine. Alternatively, a pair of rollers may be provided. A vacuum is sometimes applied to the rollers to draw the film into frictional contact with the rollers. The rollers are driven so as to pull the film through the machine.

Some packaging machines are provided with vibration members which engage the sides of the tube and cause the sides of the tube to vibrate transverse of the longitudinal direction of movement of tube to cause the product being packaged to move towards the bottom of the package being formed. Some packaging machines are provided with discreet mechanisms which engage the side of the tube and cause the sides of the tube to vibrate transverse of the longitudinal direction of movement of tube to cause the product being packed to move towards the bottom of the package being formed in the same manner as the vibration members. This is to ensure that the product occupies a minimum volume and is not engaged by the closing bars and/or the sealing heads. This ensures proper sealing of the package.

Use of the above described vibration members can require intermittent movement of the plastic film. Initially, the plastic film is moved and product delivered to the interior thereof. The film is then held stationary while it is vibrated. The film is again moved and formation of the bag completed.

The above discussed previous method of applying vibration to the tubular bag material results in low production rates and unnecessarily increases forces in the machine as the machine is continually stopping and starting in respect of movement of the bag material.

Alternatively continuous motion machines are fitted with discreet mechanisms which rely on eccentric rotary or reciprocating mechanisms to impart the transverse vibration to the film tube. These additional devices add complexity and reliability issues to the packaging machine.

OBJECT OF THE INVENTION

It is the object of the present invention to overcome or substantially ameliorate the above disadvantages.

SUMMARY OF THE INVENTION

There is disclosed herein a packaging machine through which tubular bag material passes and into which product is delivered so that upon portions of the bag material being severed discrete packages of the product are provided, said machine comprising:

drive means to engage the tubular bag material to move the tubular bag material through the machine;

control means for said drive means, said control means being adapted to govern the operation of said drive means so that the bag material is accelerated and de-accelerated a plurality of times during the formation of each discrete bag so that the tubular bag material is caused to vibrate in the direction of travel of the tubular bag material through the machine to aid in minimising volume occupied by the product during formation of the packages.

Preferably vibration of the tubular bag material would occur while maintaining movement of the tubular bag material through the machine.

There is further disclosed herein a method of packaging a product, said method including the steps of;

moving a tubular bag material through a packaging machine;

delivering product to the interior of said tubular bag material;

severing portions of the tubular bag material to produce discrete bags containing the product; and wherein the tubular bag material is caused to vibrate in the direction of movement through the machine by accelerating and de-accelerating the tubular bag material to aid in minimum volume occupied by the product during formation of the bags.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
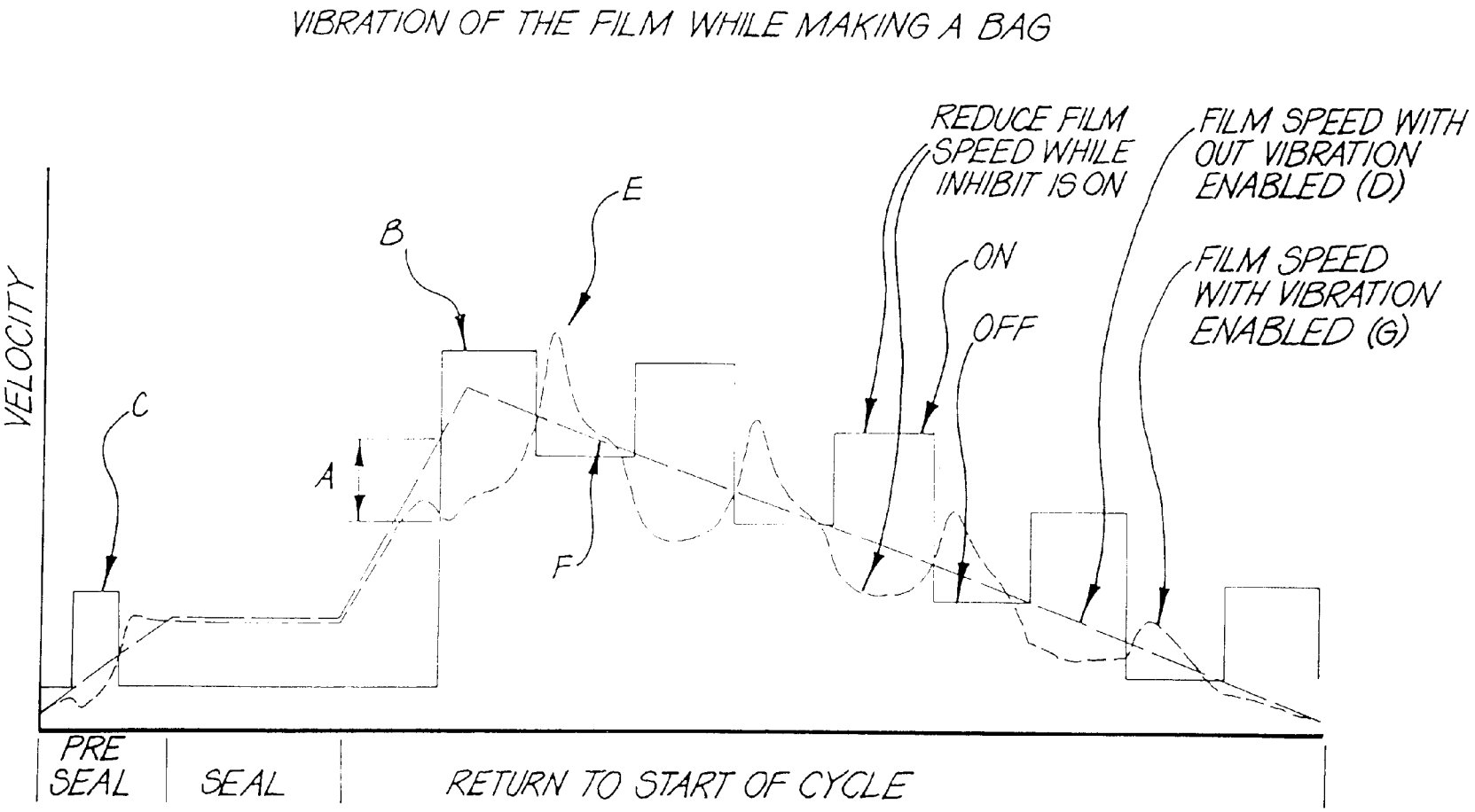
FIG. 1 is a schematic graph illustrating the velocity of tubular bag material through a packaging machine.

In the above mentioned USA patents and European patent the packaging machines described and illustrated include a drive means which engages the tubular bag material and pulls the tubular bag material through the packaging machine. For example in U.S. Pat. No. 4,910,943 the tubular bag material is engaged by co-operating rollers on opposite sides of the bag material. The rollers are driven by electric motors.

FIGS. 5 to 8 of the accompanying drawings are taken from the specification in respect of U.S. Pat. No. 4,910,943. FIGS. 5 to 8 schematically depict a film drive unit 10 of a packaging machine 11. The packaging machine 11 has a shaft 12 which receives a roll 13 of plastic film which is in strip form. The film 14 is delivered in a conventional manner to a former 15 which wraps the film 14 about a longitudinal axis so as to form tubular bag material 16. The tubular bag material is moved by means of a pair of rollers 17 and 18. Located above the former 15 is a delivery hopper 19 a lower end through which the material to be packaged is delivered into the tubular bag material 16. The tubular bag material 16, after passing the rollers 17 and 18 enters a severing and sealing assembly 30 which forms discrete bags. For example, the assembly 30 can be the stripping and sealing assembly disclosed in Australian Patent Application No 43753/85 (U.S. Pat. No. 4,663,917). The rollers 17 and 18 form part of the film drive unit, more fully depicted in FIG. 5. The rollers 17 and 18 are mounted on supports 31 and 32 which are in turn mounted on linkages 33 and 34 pivotally mounted at their joint 35 so that the rollers 17 and 18 may be adjusted in their spacing from each other. The rollers 17 and 18 are mounted on their supports 31 and 32 so as to be rotatable about generally parallel axes. Extending downwardly from within the former 15 is a back seal bar 36 which co-operates with the roller 18 to join the longitudinal edge portions of the film strip 14 to form the tubular material 16. In this particular embodiment, the longitudinal edge portions are heat sealed. It should be appreciated that the rollers 17 and 18 described in U.S. Pat. No. 4,910,943 are merely one example of how the tubular bag material may be moved through a packaging machine.

In U.S. Pat. Nos. 4,288,965, 4,128,985 and 4,423,583, the tubular bag material is engaged by belts. The belts pass around rollers which are driven by electric motors. Typically, the motors would be a stepping, servo, computer controlled or any other motor having suitable control characteristics.

In the example of FIG. 1, a control device overrides the delivery of voltage to the electric motors. The voltage supplied is computer controlled.

A signal is delivered to the control device to reduce the voltage being delivered to the electric motors and therefore reduce the velocity of the tubular bag material. Accordingly the tubular bag material is de-accelerated and accelerated to cause it to vibrate in the direction of travel of the tubular bag material, while still maintaining motion of the bag material. This causes the product to settle and therefore aid in minimising volume occupied by the product during formation of the bags.

In FIG. 1 a complete cycle is illustrated within which a package is formed. In this particular example if the voltage applied to the electric motors was maintained constant the film forming the tubular bag material would have a velocity D throughout the cycle. If the tubular bag material is to be vibrated, a signal C is delivered to the control device which reduces the voltage delivered to the motors with the result that the tubular bag material has the velocity G.

As can be noted from FIG. 1, when a signal is delivered to the control device the speed of the tubular bag material (film) is reduced. When the signal is off, the speed is increased. The speed oscillates about what would have been the speed of the film had there been no interruption by vibrating the tubular bag material. It should further be appreciated in that regard, the velocity of the bag material when vibrated still enables a bag to be completed within the same cycle time.

For example, the control device could be arranged so that the speed of the film is reduced to 70% of the speed D to produce the vibrated speed G. Such an arrangement is shown in FIG. 1.

Typically the number of signals delivered to the control device would be in the range of 3 to 50 per cycle. Preferably, the number of signals would be 10 per cycle.

It may also be advantageous to vibrate the film just prior to sealing taking place. The is illustrated by the signal C.

If a setting of 70% is selected, the speed D is reduced by an amount A to product the speed G. When the signal is off the speed of the bag material will return to the speed D at the positions F. When the signal is turned off, the speed of the bag material will increase to a peak E rather rapidly before returning to the speed D.

Figure 3:
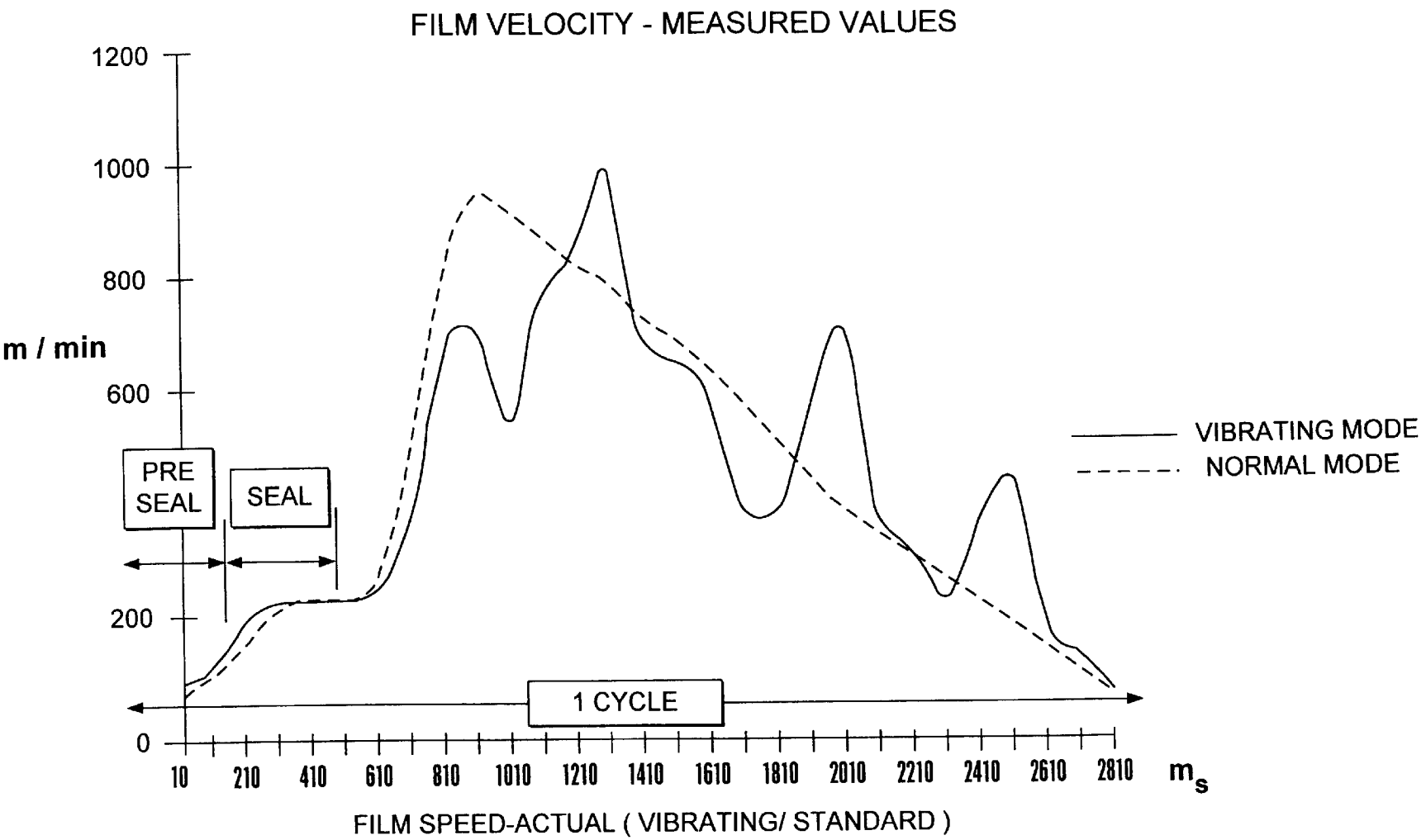
FIG. 3 is a schematic graph again illustrating the velocity of tubular bag material through a packaging machine.

FIG. 3 illustrates an actually measured example of the velocity of bag material through a machine. As can be seen from the vibration mode velocity, the tubular bag material is caused to vibrate several times during one cycle. In this particular embodiment a complete cycle takes approximately 210 milliseconds. During the cycle the tubular bag material will reach a maximum velocity of approximately 1000 meters per minute.

Figure 2:
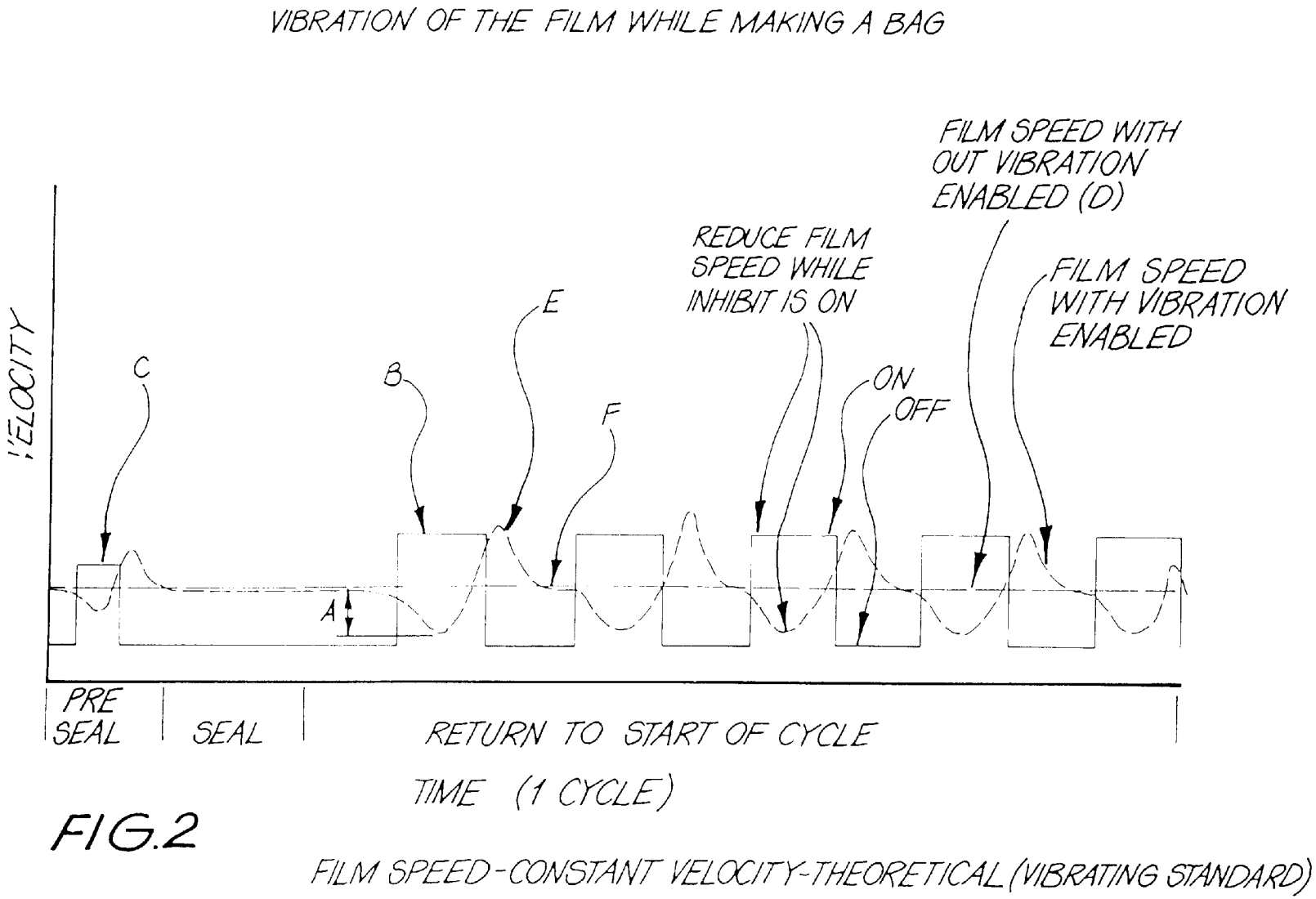
FIG. 2 is a further graph schematically depicting the velocity of tubular bag material through a packaging machine.

In FIG. 2 a further example is provided in which the uninterrupted bag material (film) speed is generally constant over the whole cycle. There is further graphed the example where five signals are delivered to the control device to produce five vibration cycles. The five signals do not include the signal delivered at the pre-seal stage.

Figure 4:
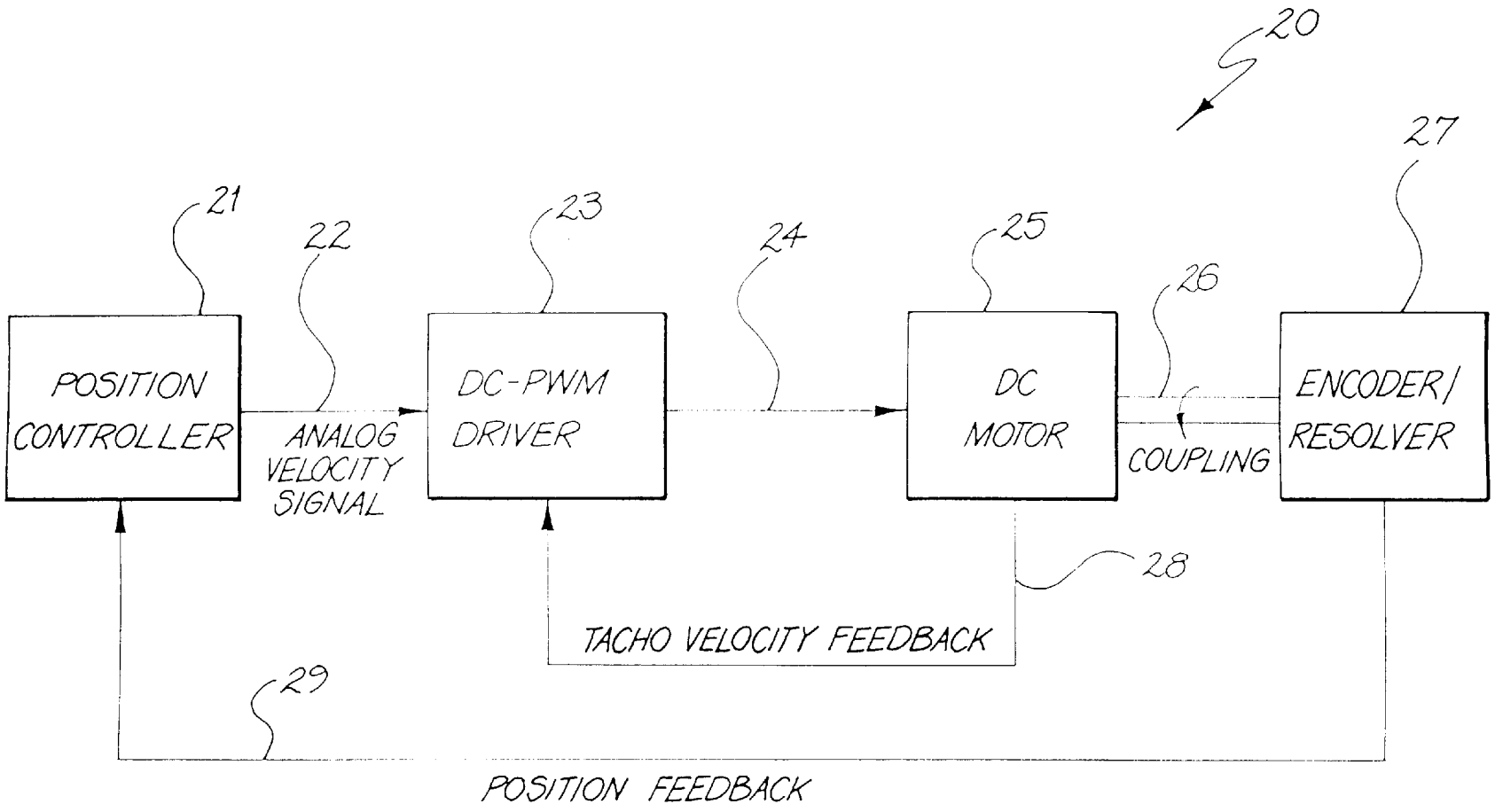
FIG. 4 is a schematic block diagram of a motor control system used in the packaging machine.
Figure 5:
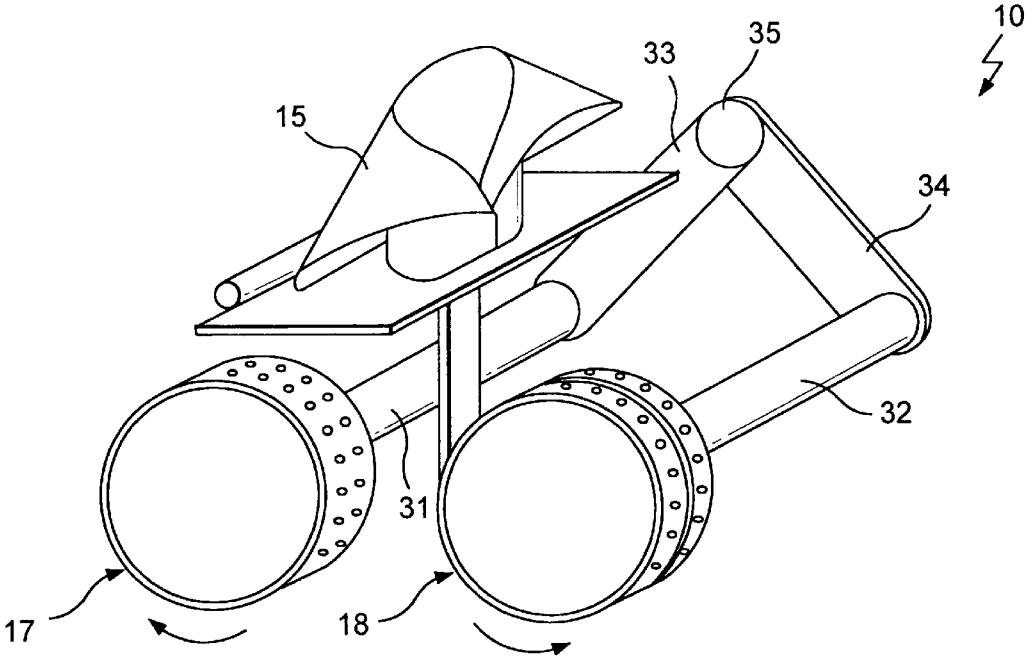
FIG. 5 PRIOR ART
FIG. 5 is a schematic perspective view of a film drive unit for a packaging machine.
Figure 6:
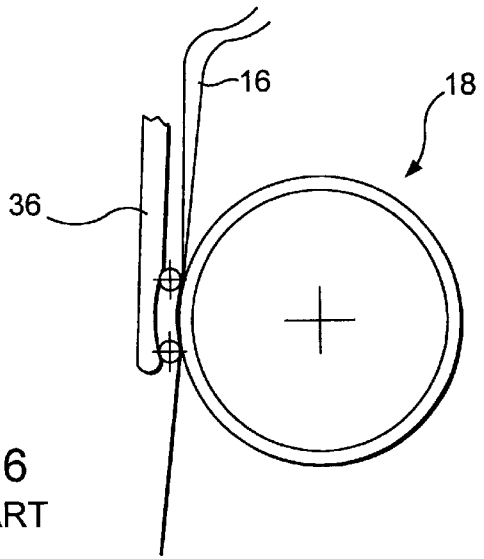
FIG. 6 PRIOR ART
FIG. 6 is a schematic side elevation of a portion of the drive unit of FIG. 5.
Figure 8:
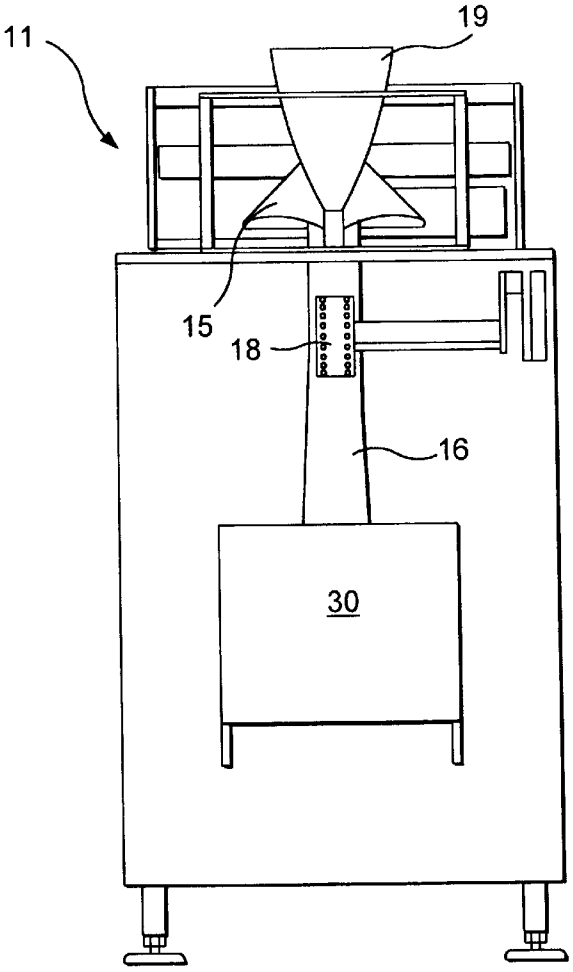
FIG. 8 PRIOR ART
FIG. 8 is a schematic end elevation of the packaging machine of FIG. 7.
Figure 7:
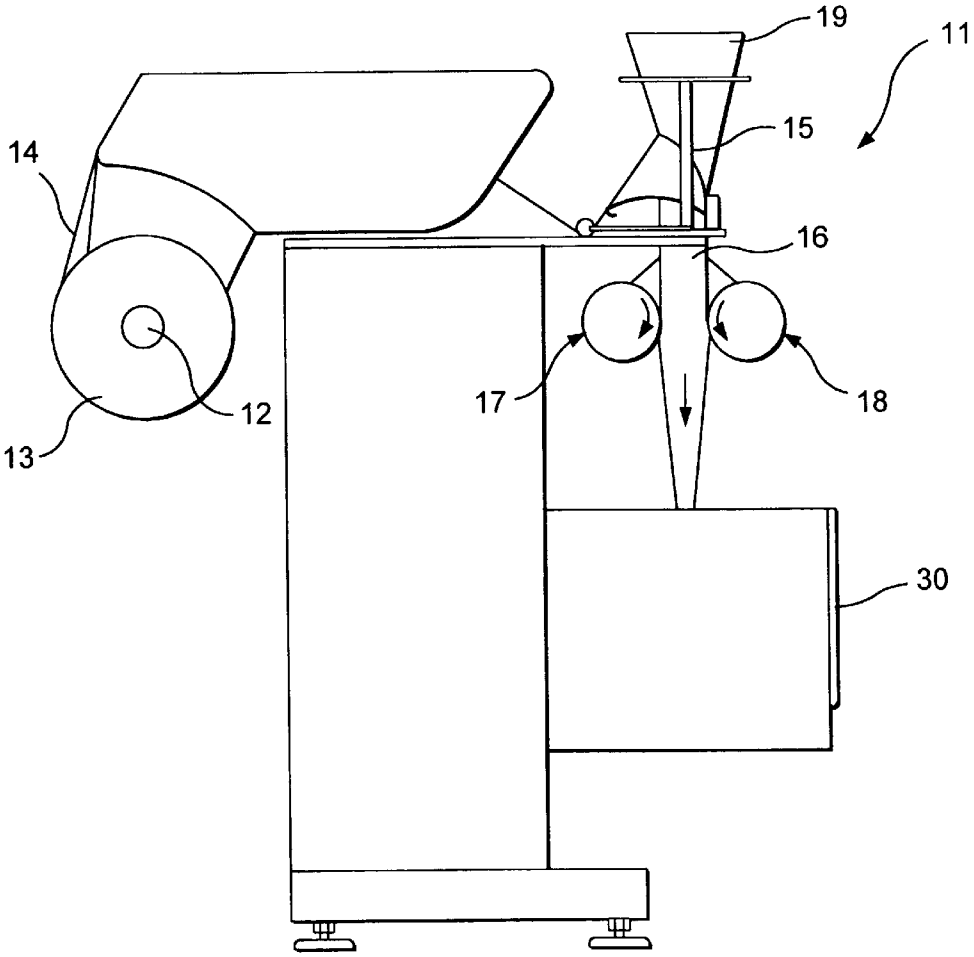
FIG. 7 PRIOR ART
FIG. 7 is a schematic side elevation of a drive unit of FIG. 5, incorporated in a packaging machine.

Referring to FIG. 4, a motor control system 20 is shown which controls a DC motor 25, typically coupled to the rollers of the packaging machines and used as described above. In particular, in order to control the speed of the motor 25, it is necessary to accurately control both the velocity of the motor 25 and its position, particularly as the tubular bag material pass through the rollers. A position controller 21 is provided which includes stored within a velocity profile that is desired for the operation of the motor 25 and with which the operation of the motor 25 is required to be matched. The position of the motor 25 is obtained using a mechanical coupling 26 connected to an encoder/resolver 27 which provides a position feedback signal 29 as an input to the position controller 21. The velocity profile stored within the position controller 21, which represents a series of motor velocities over a period of time (eg. one operation cycle of the packaging machine), is integrated and compared with the position feedback signal to provide an analog velocity signal 22 representing the desired velocity of the DC motor 25. The velocity signal 22 is input to a DC motor driver 23. The DC motor 25 also outputs a velocity feedback signal 28 obtained from an integral tachometer which is also input to the DC motor driver 23 and compared with the analog velocity signal 22 to thereby identify whether or not the actual DC motor velocity is either above or below the desired analog velocity. This comparison is used to create a pulse width modulated (PWM) drive signal 24 output from the driver 23 and which is used to power the DC motor 25. The driver 23, motor 25 and encoder 27 are each standard devices used in the art and the position controller 21 may be obtained from Anca Pty Limited of Bayswater North, Australia and provided with the velocity profile corresponding to that discussed above.

The foregoing describes only a number of embodiments of the present invention and modifications, obvious to those skilled in the art can be made thereto without departing from the scope of the present invention.

The claims defining the invention are as follows:

1. A packaging machine through which tubular bag material passes in a predetermined direction and into which product is delivered so that upon portions of the bag material being severed discrete packages of the product are provided, said machine comprising:

a drive to engage the tubular bag material to move the tubular bag material through the machine;

a control system for said drive, said control system governing the operation of said drive so that the bag material is both accelerated and decelerated a plurality of times during the formation of each discrete package which causes the tubular bag material to vibrate in said direction to aid in minimizing volume occupied by the product during formation of the packages; and wherein said control system causes the drive to vibrate the tubular bag material in the direction of travel of the tubular bag material through the machine while maintaining continuous movement of the tubular bag material in said direction.

2. The machine of claim 1, wherein said control system controls the velocity of the bag material and the position of the tubular bag material.

3. The packaging machine of claim 2, wherein said position controller includes a stored velocity profile for operation of the drive.

4. The packaging machine of claim 3, wherein the position controller controls the position of the drive by a position feedback signal delivered to the position controller.

5. The packaging machine of claim 4, wherein said drive is a DC meter, which motor receives an analogue velocity signal from said position controller so that a said motor operates at a desired velocity.

6. The packaging machine of claim 5, wherein said velocity feedback signal is obtained from an integral tachometer, which feedback signal is also an input to said motor, with said feedback signal also being compared with the analogue velocity signal to identify whether or not the motor has a velocity above or below a desired analogue velocity.

7. A method of packaging a product, said method including the steps of:

moving a tubular bag material through a packaging machine in a predetermined direction;

delivering product to the interior of said tubular bag material;

severing portions of the tubular bag material to produce discrete bags containing the product; and wherein the tubular bag material while continuously moving in said direction is vibrated in the direction of movement by at least twice accelerating and decelerating the tubular bag material to aid in minimizing volume occupied by the product in the packages during formation of each package.

* * * * *

UNITED STATES PATENT AND TRADEMARK OFFICE

CERTIFICATE OF CORRECTION

PATENT NO. : 6,158,200
DATED : December 12, 2000
INVENTOR(S) : Alfred Taylor et al.

It is certified that error appears in the above-identified patent and that said Letters Patent is hereby corrected as shown below:

Column 5,
Line 25, after "wherein said" insert -- control system includes a position controller so that the --.

Signed and Sealed this

First Day of March, 2005

JON W. DUDAS
*Director of the United States Patent and Trademark Office*